United States Patent [19]

Barlow et al.

[11] 4,436,309

[45] Mar. 13, 1984

[54] STRATEGY CARD GAME

[75] Inventors: Gordon A. Barlow, Glenview; John R. Newcomer, Des Plaines; Fred Bezark, Northbrook, all of Ill.

[73] Assignee: Gordon Barlow Design, Skokie, Ill.

[21] Appl. No.: 347,016

[22] Filed: Feb. 8, 1982

[51] Int. Cl.[3] ..... A63F 3/00

[52] U.S. Cl. ..... 273/267; 273/157 R; 273/275

[58] Field of Search ..... 273/267, 271, 275, 276

[56] References Cited

U.S. PATENT DOCUMENTS

| | | | |
|---|---|---|---|
| Re. 25,031 | 8/1961 | Hoolim | 434/96 |
| 3,638,947 | 2/1972 | Hardesty | 273/273 |
| 3,638,948 | 2/1972 | Smith | 273/275 |
| 3,677,549 | 7/1972 | Moscovich | 273/236 |
| 3,819,184 | 6/1974 | McPhail | 273/271 X |
| 3,891,217 | 6/1975 | Geary | 273/282 |
| 3,948,525 | 4/1976 | Faintuch | 273/292 X |

*Primary Examiner*—Harland S. Skogquist
*Attorney, Agent, or Firm*—Kinzer, Plyer, Dorn & McEachran

[57] ABSTRACT

A game including a game board having a base and pegs upstanding on the base arranged in columns and rows to define a grid of uniformly sized squares. A plurality of square cards each of which is divided into nine colored squares identical in size to the squares of the game board is provided. Notches are formed along the sides of each card at the corners of each square and openings are formed in the card at the corners of the center square so that the cards can be fitted over the pegs and against one another and the base of the game board. The squares on the cards are arranged in patterns of color so the cards can be placed on top of one another in a partially overlapping manner to ultimately form a pattern of nine contiguous squares of the same color when viewed from above.

3 Claims, 3 Drawing Figures

Fig. 1.
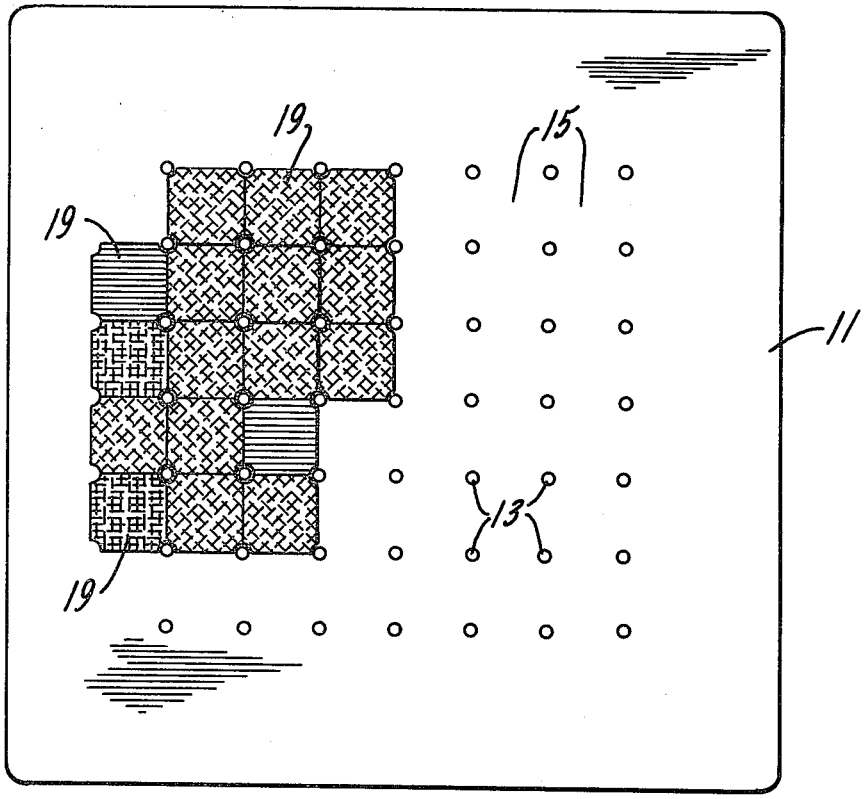
Fig. 2.
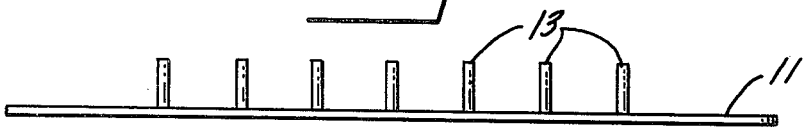
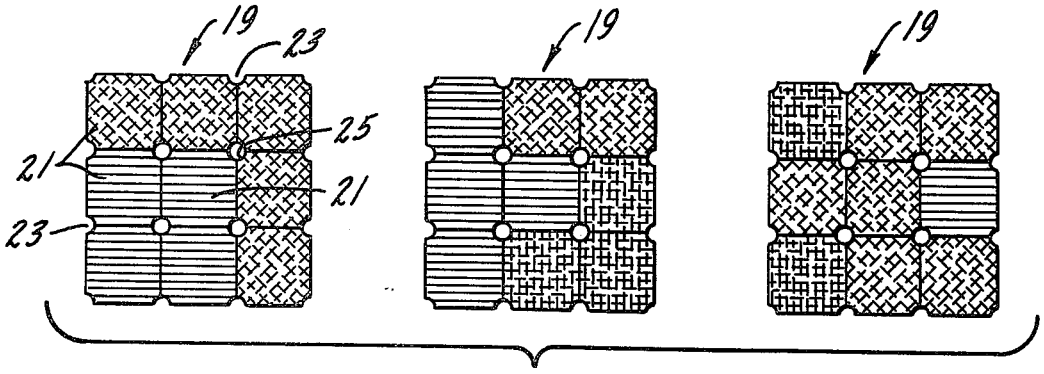
Fig. 3.

STRATEGY CARD GAME

BACKGROUND AND SUMMARY OF THE INVENTION

This invention is directed to a board game which challenges the ability of the players to visualize and arrange seemingly irregular patterns of colors to obtain a desired configuration of colors. It is more challenging than somewhat similar games in that it can be played by two or more players in a game board atmosphere.

The board game of this invention is particularly interesting because the patterns of colors need be created in only two dimensions and players compete against each other and not only against themselves. This element of competition makes the completion of a two dimensional geometric figure extremely exciting.

The degree of difficulty of the game can be varied by varying the boundaries of the board in which the cards can be placed on the pegs, the number of different colors of the squares on a particular card, the number of cards in the game and the patterns of colors on the cards. The cards can also be provided with squares which contain instructions which can help, hinder or increase the score of a particular player.

Other objects may be found in the following specification, claims and drawings.

BRIEF DESCRIPTION OF THE DRAWINGS

The invention is illustrated more or less diagrammatically in the following drawings wherein:

FIG. 1 is a top plan view of a simplified form of the game of this invention with the cards arranged to form a winning geometric pattern of a single color;

FIG. 2 is a side elevational view of the board of FIG. 1 with the cards removed for clarity of illustration; and FIG. 3 is a top plan view of the three cards used to play a simplified form of the game of this invention.

DESCRIPTION OF THE PREFERRED EMBODIMENT

The simplest form of the invention is shown and illustrated in the drawings embodied in a game having a square game board 11 formed of a suitable plastic and having upstanding pegs 13 extending from one side thereof. In this embodiment, the board is approximately ten inches square and forty-nine pegs 13 are arranged in columns and rows of seven each forming a grid pattern with the pegs being located one inch apart on centers. This pattern of pegs provides thirty six squares 15 defined by and within the pegs. A border of two inches which is equivalent to the width of two squares surround the pegs. Preferably the pegs are tapered from bottom to top for ease of molding and application and removal of the cards.

The game is played with cards 19 which are also square, preferably formed of heavy paper or light cardboard. Each card is divided into nine squares 21, each of which is colored. Notches 23 are provided along the sides of each card with a notch located at a corner of each square formed on the card. The diameter of the notches are equal to or slightly greater than the diameters of the pegs. Four peg receiving openings 25 are formed in each card and these are located at the corners of the center square 21 of the card to enable the card to be placed over the pegs of the pegboard and to rest on the board 11.

Each square 21 of a card is colored. At least six different colors can be employed with white as a seventh color. The white also functions as a background for messages which can be written on the center square 21 of a card. Suggested colors are red, blue, yellow, purple, orange and green although other color combinations may be used. Not all six colors would be placed on a single card and preferably no more than five squares of any one color would be placed on a single card. Additionally, it should be understood and appreciated that the pattern of colors on the cards can be varied considerably in order to make the game easier or more difficult to play. Since the rules of the game require that the colors be matched with each other in rows and columns rather than diagonally, squares of the same color on the cards should be preferably be contiguous in columns and rows rather than diagonally.

For clarity of illustration and to facilitate understanding of the invention of this game, only three cards 19 are shown in these cards show only three of the six colors normally provided in a deck of cards. The colors shown being blue, yellow and orange. Since these cards can be overlapped on the pegs to create a geometric pattern of nine squares of the same color when viewed from above, they can be used to complete a turn of a game. Therefore, these three cards are sufficient to demonstrate the novel aspects of this invention. Also, additional cards of almost any other colors, including the remaining red, purple and green of a set, could be provided for use with the game since they would not necessarily be needed to complete a geometric pattern of nine contiguous squares of the same color. Of course, since there are two or more players in the game, there should be more than one combination of cards that can be assembled to provide nine contiguous squares of the same color. Since there are six different colors of squares, sufficient cards should be provided so that at least one nine square combination of each color can be provided. The necessary arrangement of colors and patterns of color on the squares of the cards will become more apparent from the following study of the manner in which the game should be played:

One of the players is selected as dealer. The dealer deals each player three cards 19 face down and places the remainder of the deck of cards face down alongside the game board 11. The first player positions a card face up anywhere on the game board where it will fit over the pegs 13. The width of the game board beyond the pegs 13 permits a variation in the manner of playing the game. If desired, placement of the cards on the pegs may be restricted so that not more than one row of squares 21 of a card extends beyond the outer limit of the pattern of pegs. As a variation, the rules may provide that two rows of squares may extend beyond the outer rows of pegs. The player who has put the first card on the peg board selects and points to one of the colored squares on his card and announces that that color is the "master color". The player then takes a card from the deck to replace the one he played and the game continues with the player on the first player's left.

The next player plays a card so that a square or squares of the "master color" connects with the starting square vertically or horizontally. It is not permitted to connect the colors on diagonals. To make a connection, the player may overlap any square on a previously played card except for squares containing the connected "master color". There is one exception to this rule; a connected "master color" square can be covered by the final card that forms a round winning three by three square of the proper "master color".

Each succeeding player plays a card which extends the "master color" squares vertically or horizontally. The players replenish their hands from the deck so they always begin a playing turn with three cards. The player who plays the card which forms a solid three by three square of the "master color" wins the round. The round winner obtains points equal in number to the total of connected "master color" squares.

When a round is won, the winner of the round plays another card anywhere on the board and announces a new "master color" and a starting square. The rounds in a game continue until one player accumulates 100 points.

If a player during his turn cannot validly connect vertically or horizontally with the "master color" squares, then that player shows all of his cards in his hand to the other player and passes his turn. Before the next player begins his turn, the player who had passed closes his hand, places anyone of his cards at the bottom of the deck and draws another card. If all of the players in sequence pass, the player who began the passing then plays a card anywhere on the board and announces a new master color and starting square. The first player who accumulates 100 points wins the game. If the deck of cards is exhausted before any player obtains 100 points, the player who needs to draw a card removes all of the cards from the board, shuffles the cards and places one of these cards anywhere on the board. He then names a "master color" and a starting square. He replenishes his hand and play resumes as before.

It is also possible to modify the cards to vary the play in the game. For example, on some of the cards in the deck, the center square will be white and will have a message on it. White squares are considered non-colors and cannot be selected as a "master color". The message on the white square becomes active when the card containing the square is played on the board. In one modification, there are three white square messages. These are:

1. Change color. A player playing this card has the option of retaining the present "master color" or naming a new "master color" by pointing to a different colored square on that card.

2. Play again. A player who plays a "Play again" card immediately plays one other card from his hand if he is able. The player makes sure he draws the appropriate number of cards so that he will have three cards in his hand at the end of this turn.

3. Double score. The player who plays this card has his score doubled. If two double squares are showing, then the player score is quadrupled.

We claim:

1. A game including:

a game board having a base and pegs upstanding on the base arranged in columns and rows to define a grid of uniformly sized squares, a plurality of square cards, each card being divided into nine colored squares identical in size to the squares of the game board, notches formed along the sides of each card at the corners of each square and openings formed in the card at the corners of the center square so that the cards can be fitted over the pegs and against one another and the base of the game board, the squares on the cards being arranged in patterns of color so that the cards can be placed on top of one another in a partially overlapping manner to ultimately form a pattern of nine contiguous squares of the same color when viewed from above.

2. The game of claim 1 in which a sufficient number of cards are provided to enable two competing players to successfully form a pattern of nine contiguous squares of the same color when viewed from above.

3. The game of claim 1 in which the cards must be positioned so that no portion of any card extends more than one square beyond the outer column or row of pegs.

* * * * *